US005757172A

United States Patent [19]

Hunsdorf et al.

[11] Patent Number: 5,757,172

[45] Date of Patent: May 26, 1998

[54] TEMPERATURE AND CURRENT DEPENDENT REGULATED VOLTAGE SOURCE

[75] Inventors: Jon Hunsdorf; Charles Pellock, III; David Landfried, all of Olean, N.Y.

[73] Assignee: Acme Electric Corporation, East Aurora, N.Y.

[21] Appl. No.: 828,963

[22] Filed: Mar. 27, 1997

Related U.S. Application Data

[63] Continuation of Ser. No. 473,130, Jun. 7, 1995, abandoned.

[51] Int. Cl.[6] ..... G05F 1/573

[52] U.S. Cl. ..... 323/277

[58] Field of Search ..... 323/275, 277, 323/276, 280, 349, 267, 278, 282, 284, 360

[56] References Cited

U.S. PATENT DOCUMENTS

| | | | |
|---|---|---|---|
| 3,126,508 | 3/1964 | Eriksson et al. | 323/273 |
| 3,469,178 | 9/1969 | Gardner | 323/273 |
| 3,505,583 | 4/1970 | Burkhardt et al. | 320/1 |
| 3,559,039 | 1/1971 | Nishiwaki et al. | 323/275 |
| 3,701,004 | 10/1972 | Tuccinardi et al. | 323/275 |
| 4,313,402 | 2/1982 | Lehnhoff et al. | 123/41.12 |
| 4,381,480 | 4/1983 | Hara et al. | 318/471 |
| 4,442,397 | 4/1984 | Ishikawa et al. | 323/275 |
| 4,633,162 | 12/1986 | Melbert | 323/275 |
| 4,644,252 | 2/1987 | Wilkinson | 323/273 |
| 4,733,160 | 3/1988 | Draxelmayr | 323/314 |
| 4,806,832 | 2/1989 | Müller | 318/334 |
| 4,943,762 | 7/1990 | Campbell et al. | 323/284 |
| 4,972,136 | 11/1990 | Banura | 323/275 |
| 5,191,278 | 3/1993 | Carpenter | 323/275 |
| 5,194,803 | 3/1993 | Visser et al. | 323/360 |
| 5,364,026 | 11/1994 | Kundert | 236/49.3 |
| 5,404,094 | 4/1995 | Green et al. | 323/282 |

*Primary Examiner*—Adolf Berhane

*Attorney, Agent, or Firm*—Pearne, Gordon, McCoy & Granger LLP

[57] ABSTRACT

A linear voltage regulator is operated by a temperature sensor and a current sensor. The temperature sensor is a thermistor in a voltage divider connected across the output of the regulator. The current sensor operates a voltage follower connected to adjust the voltage in the voltage divider. The regulator controls voltage supplied to a cooling fan in a power supply. The sensed temperature is the air temperature near the power supply enclosure. The sensed current is the output current of the power supply. When the ambient temperature increases and/or the power supply output current increases, the voltage regulator increases the fan speed by raising the voltage. The current sensor can also be used to sense other parameters, such as voltage.

37 Claims, 2 Drawing Sheets

TEMPERATURE AND CURRENT DEPENDENT REGULATED VOLTAGE SOURCE

This is a continuation of application Ser. No. 08/473,130, filed Jun. 7, 1995, now abandoned.

BACKGROUND OF THE INVENTION

1. Field of the Invention

This invention relates generally to the field of voltage regulators and specifically to a temperature and current dependent fan control.

2. Description of the Related Art

Electrical devices, such as power supplies, commonly require cooling fans to prevent overheating of components. Some fans operate continuously at full speed, which wastes energy and wears out the fan prematurely. Other fans are operated intermittently or at different speeds based on a sensed temperature of the device. For example, it is known to use a thermistor to control the output voltage of a voltage regulator used to power a cooling fan. The thermistor is connected in a voltage divider connected across the output of the regulator. A central node of the voltage divider is connected to the adjust connection of the regulator. As the resistance of the thermistor varies with temperature, the voltage at the adjust connection varies; therefore, the speed of the fan varies. Temperature controlled cooling fans are also used in other environments. U.S. Pat. No. 4,313,402 to Lehnhoff shows a controller for a fan used to cool an engine compartment. U.S. Pat. No. 4,381,480 to Hara shows a temperature controlled blower for an automobile passenger compartment.

Temperature dependent regulated voltage sources are also used to control the voltage supplied to other types of loads. For example, U.S. Pat. No. 3,126,508 to Eriksson, U.S. Pat. No. 3,505,583 to Burkhardt, U.S. Pat. No. 4,733,160 to Draxelmayer, U.S. Pat. No. 4,806,832 to Muller, U.S. Pat. No. 5,364,026 to Kundert, U.S. Pat. No. 3,701,004 to Tuccinardi, and U.S. Pat. No. 4,972,136 to Banura show temperature controlled power supplies.

Some power supplies use a sensed current to control voltage. U.S. Pat. No. 4,442,397 to Ishikawa, U.S. Pat. No. 5,191,278 to Carpenter, and U.S. Pat. No. 3,559,039 to Nishiwaki all show power supplies that control voltage based on a sensed current.

The need remains for a voltage controller that is independently responsive to two parameters, specifically temperature and current. In particular, the voltage should be used to control a cooling fan in a power supply.

SUMMARY OF THE INVENTION

The present invention provides a voltage controller including a linear voltage regulator having an input connection, an output connection, and an adjust connection. A voltage divider has a first leg connected between the output connection and the adjust connection and a second leg connected between the adjust connection and ground. The voltage divider defines a central node connected to the adjust connection. A thermistor is connected in the first leg of the voltage divider so as to vary a voltage at the adjust connection proportionally with a temperature sensed by the thermistor. A voltage follower connected at the second leg of the voltage divider, and a current sensor is adapted for varying an output voltage of the voltage follower so as to vary the voltage at the adjust connection proportionally with a sensed current. A fan connected between the output and ground, the speed of the fan being controlled by the output voltage of the regulator. A direct current input voltage is connected between the input connection and ground to supply the regulator.

The invention also provides a power supply including an enclosure and a power source disposed in the enclosure and adapted for providing a variable output current to a load. The fan is adapted for conveying cooling air through the enclosure. The thermistor is disposed at the enclosure and adapted for sensing temperature at the enclosure for varying voltage at the adjust connection proportionally with the sensed temperature. The current sensor connected for varying the voltage at the adjust connection proportionally with the output current to the load.

DESCRIPTION OF THE PREFERRED EMBODIMENTS

Figure 1:
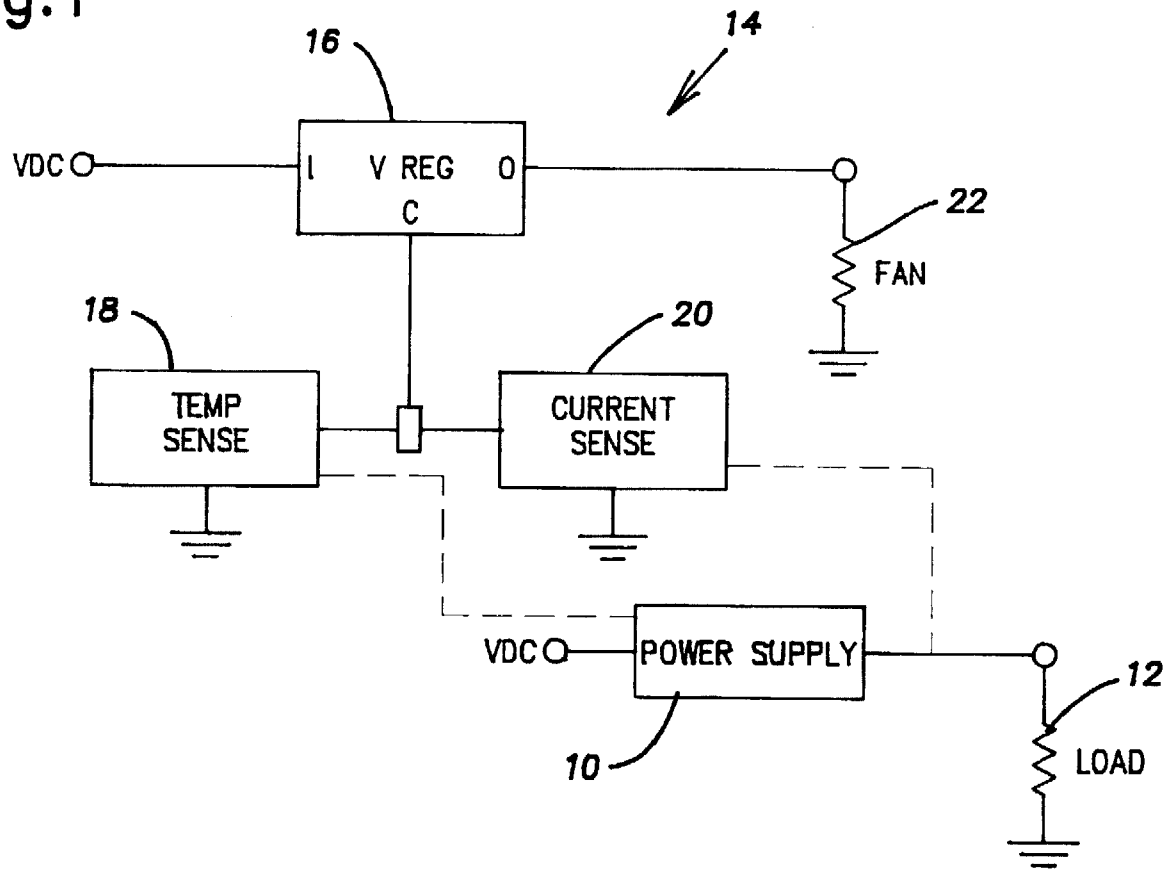
FIG. 1 shows a block diagram of a voltage source according to the invention.

Referring to FIG. 1, a power supply 10, such as an inverting or voltage regulating power source housed in an enclosure 11, is connected to supply one or more primary loads 12, such as electronic devices. A voltage control circuit 14 includes a voltage regulator 16 having input I, output O, and adjust C connections. Two parameter sensors, a temperature sensor 18 and a current sensor 20, are connected to the adjust connection C for independently controlling voltage at the output O of the voltage regulator 16. The power supply 10 and voltage regulator 16 are powered by the same or different power sources, such as 30 VDC or rectified AC. In the following description, the power supply 10 and voltage control circuit 14 operate with direct current, but the principles could be applied to alternating current circuits as well.

In a preferred embodiment shown in FIG. 1, the voltage control circuit 14 is connected for controlling power supplied to an auxiliary load, such as a fan 22 used for conveying cooling air through the enclosure housing the power supply 10. The temperature sensor 18 is connected for sensing ambient temperature near or in the enclosure, and the current sensor 20 is connected for sensing output current supplied to the primary load 12 by the power supply 10. Alternatively, the current sensor 20 can be replaced with a different parameter sensor adapted for sensing a different parameter, such as voltage.

In operation, the temperature at the enclosure varies because of changing ambient temperatures and changing loads. The temperature sensor 18 controls the output voltage of the voltage regulator 16 based on the temperature sensed. As the temperature at the enclosure increases, the voltage increases, thereby increasing the speed of the fan to provide more cooling air. In addition, the primary load 12 has varying power demands that cause the output current of the power supply to fluctuate. The current sensor 20 independently controls the voltage output based on the current sensed. As the load 12 draws more current, the cooling fan 22 speed increases to provide more cooling air.

Of course, the voltage control circuit 14 can be connected to sense parameters in circuits other than power supplies in which fan speed is to be controlled based on two sensed parameters. Moreover, the control circuit can be connected to control devices other than fans for obtaining variable power output based on two sensed parameters.

Figure 2:
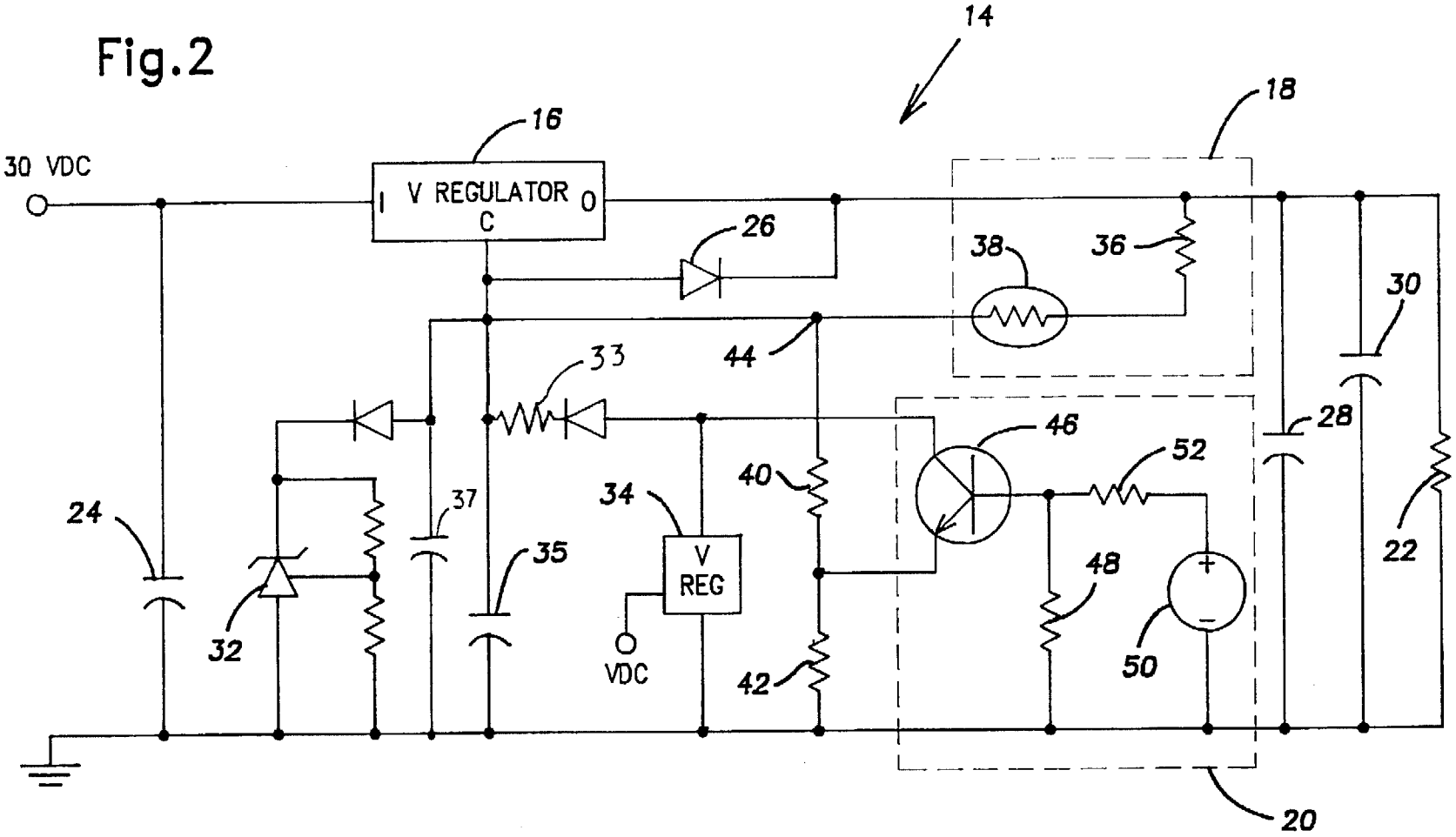
FIG. 2 shows a circuit diagram of the voltage source.

FIG. 2 shows one example of a circuit configuration for the voltage control circuit 14 according to the invention. Preferably, the voltage regulator 16 comprises a linear voltage regulator such as an LM317 adjustable positive output regulator, but could be simply a power transistor or a more complex voltage control. The output voltage of the regulator 16 is about 1.25 volts greater than the adjust voltage C. The maximum output voltage is about 3 volts less than the input voltage.

The regulator is connected to a 30 VDC supply and an input filter capacitor 24. An output diode 26 is connected between the output O and the adjust connection C for short circuit protection. If the output is short circuited, the output diode 26 pulls down the adjust voltage to prevent self destruction of the regulator 16. Output filter capacitors 28, 30 are connected across the output O in parallel with the fan 22 or other load. A zener diode regulator 32 clamps the adjust voltage at about 27 volts maximum, and a clamping linear voltage regulator 34, connected through a diode and a 249 Ω resistor 33, clamps the adjust voltage at about 15 volts minimum. A 0.1 μF capacitor 35 is connected at the adjust connection C for stability. A 10 μF capacitor 37 is connected at the adjust connection C and, with the resistor 33, is used for softstart at power up.

A voltage divider is connected across the output of the regulator 16. A first leg of the voltage divider has a calibration resistor 36 and a negative temperature coefficient, temperature dependent resistor, such as a thermistor 38. A second leg of the voltage divider includes two resistors 40, 42. Suitable values of the resistors 36, 38, 40, and 42 are 10 Ω, 1 kΩ (nominal), 9.31 kΩ, and 249 Ω, respectively. The legs of the voltage divider define a central node 44 connected to the adjust connection C of the regulator 16.

The thermistor 38 and calibration resistor 36 define the temperature sensor 18. The thermistor 38 is located in thermal communication with the temperature to be sensed, in FIG. 1, the temperature at the power supply 10. As the temperature increases, the resistance of the thermistor 38 decreases. Therefore, the voltage at the node 44 increases thereby adjusting the regulator 16 to increase the output voltage to the fan 22. When the temperature decreases, the opposite occurs. The value of the calibration resistor 36 can be changed depending on the output voltage range and the value of the thermistor. The calibration resistor value can also be changed to alter the rate at which output voltage changes with respect to the temperature change, that is, the slew rate.

The second parameter sensor, the current sensor 20, is connected in the second leg of the voltage divider. A transistor 46, such as an MPSA06, is configured as a voltage follower with its collector connected to the output of the clamping regulator 34. The emitter is connected between the second leg resistors 40, 42 of the voltage divider. A discharge resistor 48 of about 10 kΩ is connected between the base and ground. A voltage source 50 having a voltage that is directly proportional to the sensed parameter drives the transistor 46 through an input resistor 52. Preferably, the voltage source 50 provides a variable output in the range of 0 to 5.75 volts. The input resistor is selected based on the output of the voltage source. As shown, the input resistor is 10 Ω.

The voltage source 50 is connected to provide a voltage that is proportional to a sensed parameter. In FIG. 1, the sensed parameter is output current of the power supply 10. As the output current increases, the voltage source raises the voltage at the node 44 in the voltage divider. Thus, the adjust voltage increases thereby increasing the voltage supplied to the fan 22. When the output current decreases, the opposite occurs.

In operation, the power supply 10 delivers a relatively steady current to the primary load 12, and the temperature of the power supply remains fairly constant. The fan 22 runs at a constant speed. When the ambient temperature increases, the thermistor 38 resistance decreases. Thus, the increased voltage supplied to the fan increases the fan speed to provide additional cooling of the power supply, thereby maintaining the power supply temperature relatively constant. When the output current of the power supply 10 increases, the voltage source 50 adjusts the voltage regulator 16 to further increase the fan speed, thereby providing additional cooling. When the output current decreases, the fan speed decreases. Similarly, the fan speed decreases when the temperature decreases. Thus, the fan only operates to the extent necessary for adequate cooling based on ambient conditions and load requirements.

The performance of the fan 22 can be visualized as a plot of speed (based on regulator output voltage) against sensed temperature, having a relatively linear, positive slope in the operating range. The current sensor 20 provides a DC offset or shifting of this plot proportionally to the sensed current. Where desired, the plot representing fan speed can also be modified to be nonlinear or have a negative slope by suitable substitution and reconfiguration of the components. The control circuit 14 can also be used to sense other parameters and control other loads.

The present disclosure describes several embodiments of the invention, however, the invention is not limited to these embodiments. Other variations are contemplated to be within the spirit and scope of the invention and appended claims.

What is claimed is:

1. A voltage control circuit comprising:

a voltage regulator controlling a first parameter;

a temperature sensor; and a parameter sensor sensing a second parameter independent of the first parameter controlled by the voltage regulator;

said temperature sensor and said parameter sensor being connected to control the voltage regulator.

2. A voltage control according to claim 1 wherein the voltage regulator is linear and has input, output, and adjust connections.

3. A voltage control according to claim 2 wherein the temperature sensor comprises:

a voltage divider having a first leg connected between the output connection and the adjust connection and a second leg connected between the adjust connection and ground, said voltage divider defining a central node connected to the adjust connection; and a temperature dependent resistor connected in a leg of the voltage divider.

4. A voltage control according to claim 3 wherein the parameter sensor comprises a current sensor connected at a leg of the voltage divider.

5. A voltage control according to claim 4 wherein the parameter sensor further comprises a voltage follower connected at the leg of the voltage divider including the current sensor, and said current sensor is adapted for varying an output voltage of the voltage follower so as to vary a voltage at the central node proportionally with a sensed current.

6. A voltage control according to claim 3 wherein the parameter sensor comprises a voltage sensor connected at a leg of the voltage divider.

7. A voltage control according to claim 1 wherein the parameter sensor comprises a current sensor.

8. A voltage control according to claim 7 wherein the current sensor is adapted for sensing an output current of a power source.

9. A voltage control according to claim 8 further comprising a fan receiving power from the regulator and adapted for cooling the power source.

10. A voltage control according to claim 1 wherein the sensors are adapted for controlling the voltage independently from each other.

11. A voltage control according to claim 1 wherein an output of the parameter sensor is connected at a node between an output of the regulator and ground.

12. A voltage control according to claim 1 wherein the temperature sensor is a temperature dependent resistor.

13. A voltage control according to claim 1 wherein the temperature sensor is adapted for sensing temperature at a power supply device.

14. A voltage control according to claim 13 further comprising a fan receiving power from the regulator and adapted for cooling the power supply.

15. A voltage control according to claim 1 further comprising a fan receiving power from the regulator.

16. A voltage control according to claim 1 further comprising a direct current voltage source connected for supplying power to the regulator.

17. A voltage control according to claim 1, wherein the second parameter is independent of an output voltage of the voltage regulator.

18. A voltage control according to claim 1, further comprising a controlled load receiving power from the regulator.

19. A voltage control according to claim 18, wherein the parameter sensor is connected to sense a parameter independent of the controlled load.

20. A voltage control according to claim 15, wherein the fan is disposed for cooling an object and the sensors are connected to sense temperature and a parameter, respectively, corresponding with the object.

21. A voltage controller according to claim 1, further comprising a short circuit protection diode connected at an output of the regulator.

22. A voltage controller according to claim 1, further comprising upper and lower voltage clamps connected to limit the voltage range applied to control the voltage regulator.

23. A voltage control according to claim 5, wherein the temperature dependent resistor is connected in the first leg and the current sensor is connected at the second leg.

24. A voltage controller comprising:

a linear voltage regulator having an input connection, an output connection, and an adjust connection;

a voltage divider having a first leg connected between the output connection and the adjust connection and a second leg connected between the adjust connection and ground, said voltage divider defining a central node connected to the adjust connection;

a thermistor connected in a leg of the voltage divider so as to vary a voltage at the adjust connection proportionally with a temperature sensed by the thermistor;

a voltage follower connected at a leg of the voltage divider;

a current sensor adapted for varying an output voltage of the voltage follower so as to vary the voltage at the adjust connection proportionally with a sensed current; and a direct current input voltage connected between the input connection and ground.

25. A voltage controller according to claim 24, further comprising a fan connected between the output and ground, speed of the fan being controlled by output voltage of the regulator.

26. A power supply comprising:

an enclosure;

a power source disposed in the enclosure and adapted for providing a variable output current to a load;

a fan adapted for conveying cooling air through the enclosure; and a voltage control circuit connected to control the fan, said voltage control circuit comprising:

a voltage regulator controlling a first parameter;

a temperature sensor adapted for sensing temperature at the enclosure; and a parameter sensor for sensing a second parameter of the power source independent of the first parameter controlled by the voltage regulator;

said temperature sensor and said parameter sensor being connected to control the voltage regulator.

27. A voltage control according to claim 26 wherein the voltage regulator has input, output, and adjust connections, and the temperature sensor comprises:

a voltage divider having a first leg connected between the output connection and the adjust connection and a second leg connected between the adjust connection and ground, said voltage divider defining a central node connected to the adjust connection; and a temperature dependent resistor connected in a leg of the voltage divider.

28. A voltage control according to claim 27 wherein the parameter sensor comprises a current sensor connected at a leg of the voltage divider.

29. A voltage control according to claim 28 wherein the parameter sensor further comprises a voltage follower connected at the leg of the voltage divider including the current sensor, and said current sensor is adapted for varying an output voltage of the voltage follower so as to vary a voltage at the central node proportionally with a sensed output current of the power source.

30. A voltage control according to claim 26 wherein the parameter sensor comprises a current sensor.

31. A voltage control according to claim 30 wherein the current sensor is adapted for sensing an output current of the power source.

32. A voltage control according to claim 26 wherein the sensors are adapted for controlling the voltage independently from each other.

33. A voltage control according to claim 18 wherein the parameter sensor is connected at a node between an output of the regulator and ground.

34. A voltage control according to claim 18 wherein the temperature sensor is a temperature dependent resistor.

35. A voltage control according to claim 18 wherein the temperature sensor is adapted for sensing temperature at the power source.

36. A voltage control according to claim 29, wherein the temperature dependent resistor is connected in the first leg and the current sensor is connected at the second leg.

37. A power supply comprising:

an enclosure;

a power source disposed in the enclosure and adapted for providing a variable output current to a load;

a fan adapted for conveying cooling air through the enclosure;

a linear voltage regulator having an input connection, an output connection, and an adjust connection;

a voltage divider having a first leg connected between the output connection and the adjust connection and a second leg connected between the adjust connection and ground, said voltage divider defining a central node connected to the adjust connection;

a thermistor disposed at the enclosure, adapted for sensing temperature at the enclosure, and connected in the first leg of the voltage divider for varying a voltage at the adjust connection proportionally with the sensed temperature;

a voltage follower connected at the second leg of the voltage divider;

a current sensor connected for varying an output voltage of the voltage follower so as to vary the voltage at the adjust connection proportionally with the output current to the load; and a direct current voltage connected between the input and ground.

* * * * *

UNITED STATES PATENT AND TRADEMARK OFFICE

CERTIFICATE OF CORRECTION

PATENT NO. : 5,757,172
DATED : May 26, 1998
INVENTOR(S) : Jon Hunsdorf, Charles Pellock III and David Landfried It is certified that error appears in the above-identified patent and that said Letters Patent is hereby corrected as shown below:

Col. 6, claim 33, line 60, delete "18" and insert therefor --26--.

Col. 6, claim 34, line 63, delete "18" and insert therefor --26--.

Col. 6, claim 35, line 65, delete "18" and insert therefor --26--.

Signed and Sealed this

Eighth Day of September, 1998

*Attest:*

Bruce Lehman

BRUCE LEHMAN

*Attesting Officer*

*Commissioner of Patents and Trademarks*